United States Patent [19]

Barber

[11] 4,349,179

[45] Sep. 14, 1982

[54] CONTROL MEANS FOR MOTION COMPENSATION DEVICES

[75] Inventor: Norman R. Barber, Kent, England

[73] Assignee: GEC Mechanical Handling Limited, Kent, England

[21] Appl. No.: 148,253

[22] Filed: May 9, 1980

[30] Foreign Application Priority Data

Jun. 19, 1979 [GB] United Kingdom ..... 7921366

[51] Int. Cl.[3] ..... B66D 1/50

[52] U.S. Cl. ..... 254/270; 114/245; 114/254; 114/294; 254/275; 254/338; 254/386; 254/900

[58] Field of Search ..... 254/275, 200, 900, 338, 254/386; 114/254, 244, 245, 294

[56] References Cited

U.S. PATENT DOCUMENTS 3,259,371 7/1966 Goeffert ..... 254/900

3,309,065 3/1967 Prudhomme ..... 254/900

3,596,070 7/1971 McCool ..... 235/151

*Primary Examiner*—Billy S. Taylor

*Attorney, Agent, or Firm*—Kirschstein, Kirschstein, Ottinger & Cobrin

[57] ABSTRACT

A control system for stabilizing a body suspended by a flexible line from a structure such as a ship, which is subject to uncontrolled oscillating movements, such as may be caused by wave motion, incorporates a winch (3) to which the line is attached, a pulley (4) over which the line (2) passes and from which the body is suspended, and a loop in the line between the winch and pulley, an accelerometer (28) being located adjacent the pulley, and the length of the loop being altered in controlled response to a stabilizing signal formed by combining signals derived from the accelerometer, and from the measured amplitude of oscillations of the loop length, and modified by a compensating signal to compensate for the effect of friction in the system.

4 Claims, 5 Drawing Figures

CONTROL MEANS FOR MOTION COMPENSATION DEVICES

This invention relates to control systems for motion compensation arrangements of the kind designed to provide at least a degree of stabilisation of a body suspended by means of a rope, cable or the like, hereinafter referred to simply as a cable, from a support structure which is liable to uncontrolled movements, and primarily but not exclusively for the stabilisation of bodies vertically suspended in the sea from vessels or other floating bodies which are subject to the combined effects of wave motion and wind and current forces. Typically the body might be suspended over the bows or stern of a vessel of conventional shape and proportions in which case heave and pitch are the principal vessel motions for which compensation is sought. Alternatively the body might be suspended over the side of the vessel in which case heave and roll would be the motions of principal interest in the compensation process. Similar requirements arise in cases of semi-submersible drilling rigs and the like. Such vessels commonly do not roll or pitch to any significant extent but may still be subject to the effects of heave, and hence the fitting of motion compensators may be necessary to obtain the desired stability of the suspended body. Typically the suspended body may be a diving chamber or other underwater device which for some reason it is desired should be maintained stationary or substantially stationary relative to the sea bed regardless of the effects of the combined vertical components of the motions of the vessel from which it is suspended. An ideal motion compensator would maintain the suspended body perfectly stationary relative to the sea bed regardless of the severity of the vertical velocities and accelerations of its point of suspension from the supporting vessel.

As is already well known to those versed in the art, motion compensators commonly take one of two forms referred to respectively as "passive" and "active".

A "passive" compensator is one in which the amount of compensation is dependent on the extent of the displacement of the compensating system from an equilibrium position, whereas an "active" compensator is one in which the amount of compensation is altered in response to one or more measurements of the extent of the motion compensated for.

Embodiments of "passive" and "active" compensators of the type for use in the stabilisation of bodies suspended in the sea from vessels or the like which are subject to the combined effects of wave motion and wind and current forces will now be described with reference to FIGS. 1 to 5 of the accompanying drawings.

Figure 1:
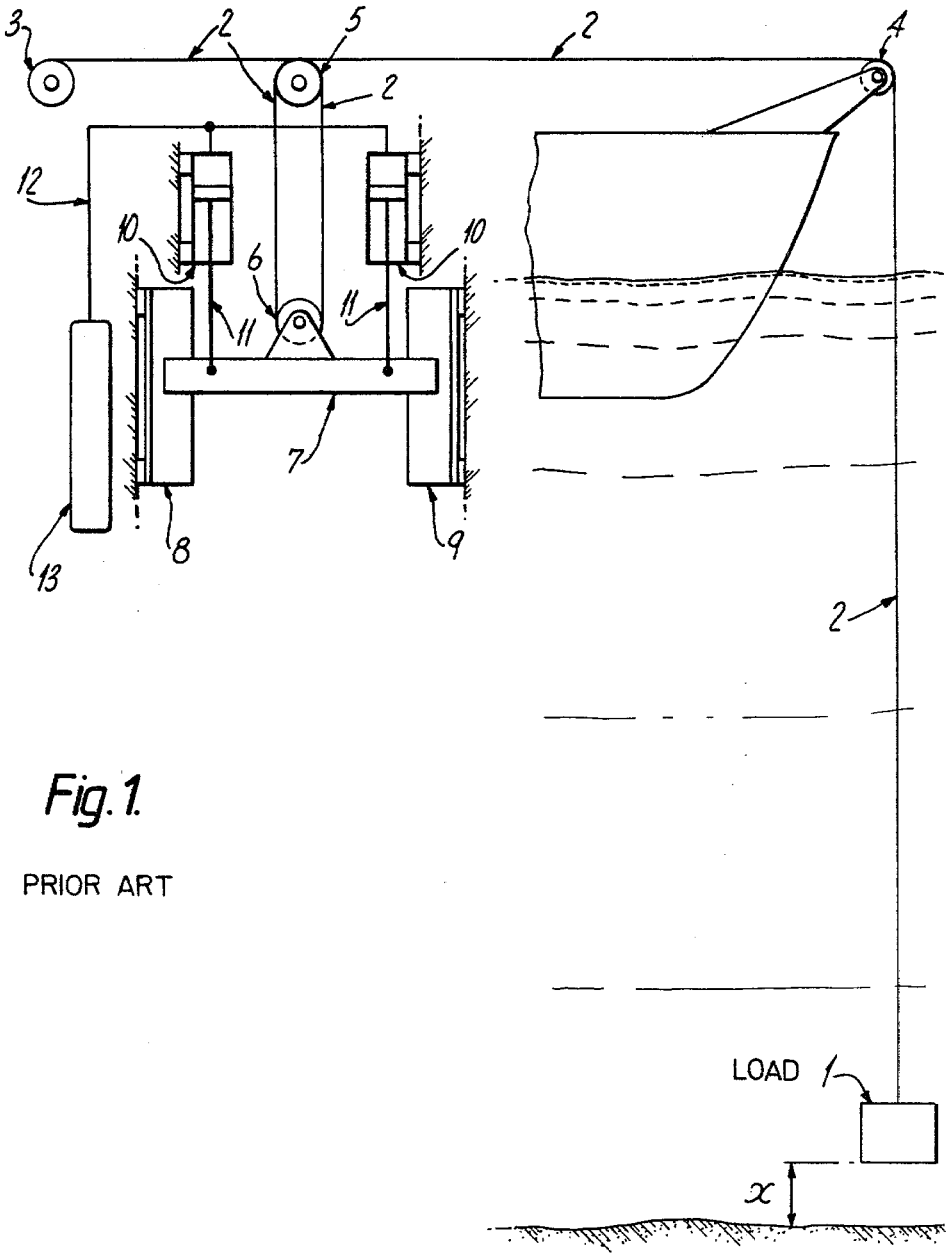
Fig. 1. PRIOR ART
FIG. 1 shows a "passive" compensator according to established practice.

Referring to FIG. 1, which shows diagrammatically a typical outline configuration of a passive motion compensator, the underwater body 1 is suspended on a cable 2 which is wound on to a winch drum 3 after passing over the bow pulley 4 and the passive compensator pulleys 5 and 6. The pulley 6 is attached to a crosshead 7 which is guided by guides 8 and 9 attached to the structure of the vessel. The cable 2 passes over the fixed compensator pulley 5 and the moving compensator pulley 6 on its way from the winch drum 3 to the suspended body 1. The winch 3 is used initially to set the position of the suspended body 1 relative to the sea bed or other target datum as represented by the distance x. In the case considered the immersed weight of the body 1 and the vertical run of the cable 2 together constitute a greater weight than that of the combination of the crosshead 7 and the pulley 6. Hence in the absence of an opposing force there would be a tendency for the crosshead 7 to rise vertically under the weight of the suspended body 1 and the cable 2. Such an opposing force is supplied by one or more pneumatic cylinders 10 the piston rods 11 of which are attached to the crosshead 7. The bodies of the cylinders 10 are rigidly connected to the structure of the vessel. The pneumatic cylinders 10 are connected by pipes 12 to a pressure vessel 13. The pressure vessel 13 can be pre-pressurised to any desired level thus exerting a permanent pressure force on the bore side of the cylinders 10. Thus the crosshead 9 is effectively "spring loaded" by the pneumatic cylinder/-pressure vessel system 10, 13 and providing the "spring rate" is suitably low, i.e. the volume of the vessel 13 is suitably larger than the swept volume of the cylinders 10, the drag forces and inertia of the suspended body 1 will tend to cause the body 1 to oscillate vertically relative to the sea bed with a lesser amplitude than that of the bow sheave 4. The force to overcome coulomb friction and sustain the motion of the crosshead 7 must be generated by acceleration of the suspended body 1 and hence the amplitude of motion of the suspended body 1 is at all times substantial, and may become very large at low frequencies of wave encounter.

To reduce these problems and improve the dynamic performance of the motion compensator system, so called "active" forms of compensator have been evolved. An outline configuration of an active motion compensator system is shown diagrammatically on FIG. 2.

Figure 2:
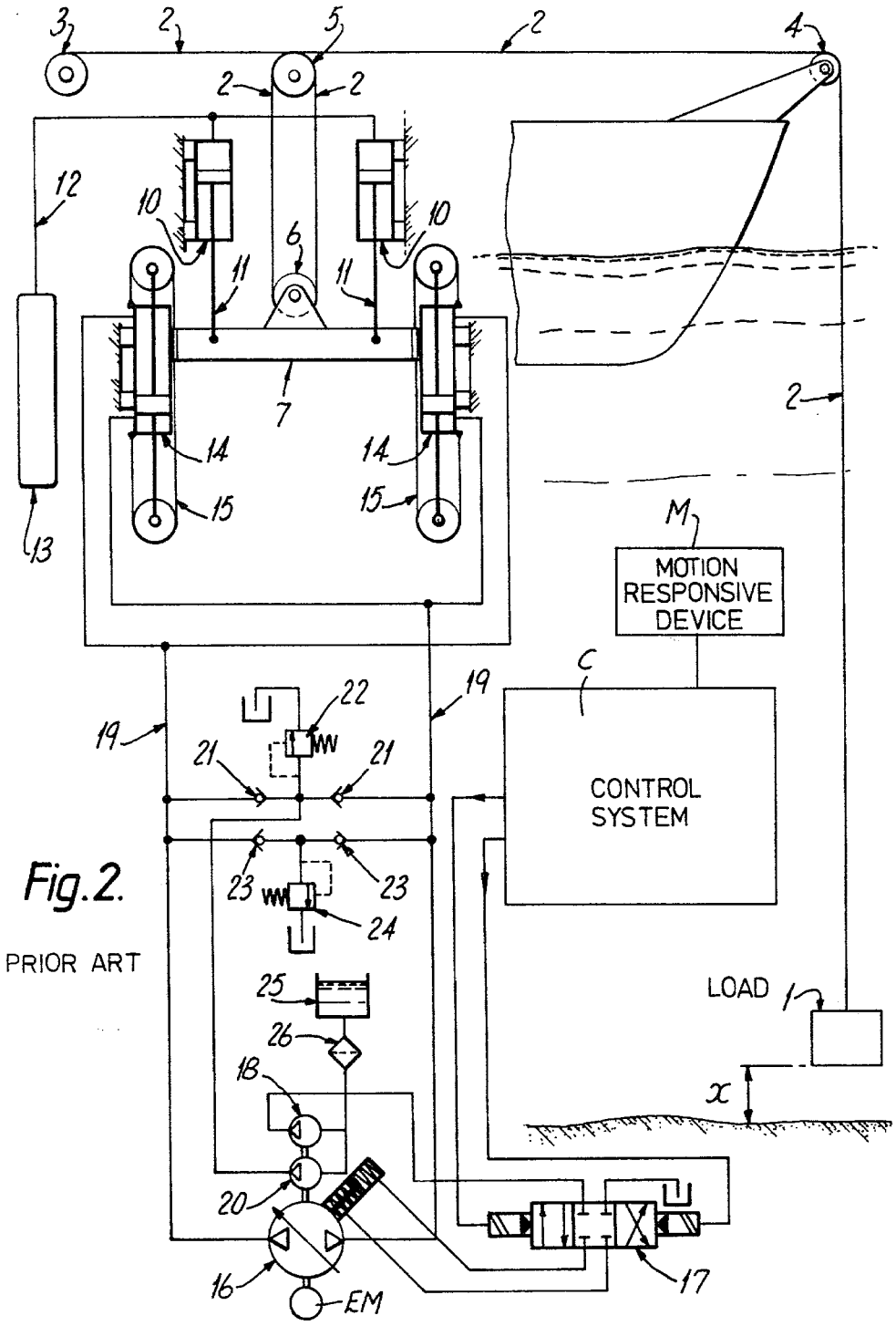
Fig. 2. PRIOR ART
FIG. 2 shows an "active" compensator according to established practice.

According to FIG. 2 a typical active motion compensator system will be seen to comprise all of the elements of the passive system shown on FIG. 1 with the addition of a hydraulic sub-system based on one or more equal area hydraulic cylinders. For the sake of clarity, the crosshead guides 8 and 9 of FIG. 1 are omitted from FIG. 2. The additional elements which comprise the hydraulic sub-system constitute a hydrostatic drive arrangement based on the two balanced area cylinders 14 which are arranged in a 2:1 configuration relative to the crosshead 7 by means of the drive chains 15. The bodies of the cylinders 14 are attached to the vessel structure. The cylinders 14 are powered by a variable displacement hydraulic pump 16. This unit is stroked by an electro-hydraulic servo-valve 17 which is supplied with high pressure fluid by a small auxiliary pump 18. The hydro-static loop 19 is boosted by a further auxiliary pump 20 via a pair of check valves 21, a relief valve 22 is provided to set the boost pressure. The hydrostatic transmission is completed by a further pair of high pressure check valves 23 and a high pressure relief valve 24. The hydraulic system also includes a fluid reservoir 25 and a normal complement of filters 26 and other ancillary items.

It will also be known to those versed in the art that there are two principal modes of application of active motion compensators. One mode is illustrated in FIG. 2 and in this arrangement control of the servo-valve 17 is effected by a control system C responsive to signals generated, say, by a suitable motion responsive device M. It will be seen that in that case no direct measurement of the vertical distance between the vessel and the sea bed takes place. Hence in this mode there will be a tendency for long term drift resulting in a variation of the dimension "x" of that figure to a time scale measured in minutes or hours. One aspect of the present invention is directed towards the achievment of semi automatic compensation for the long term drift of the suspended body relative to the sea bed. The second aspect of the invention is concerned with the generation and application of a signal to provide correction for the effects of coulomb friction.

Figure 3:
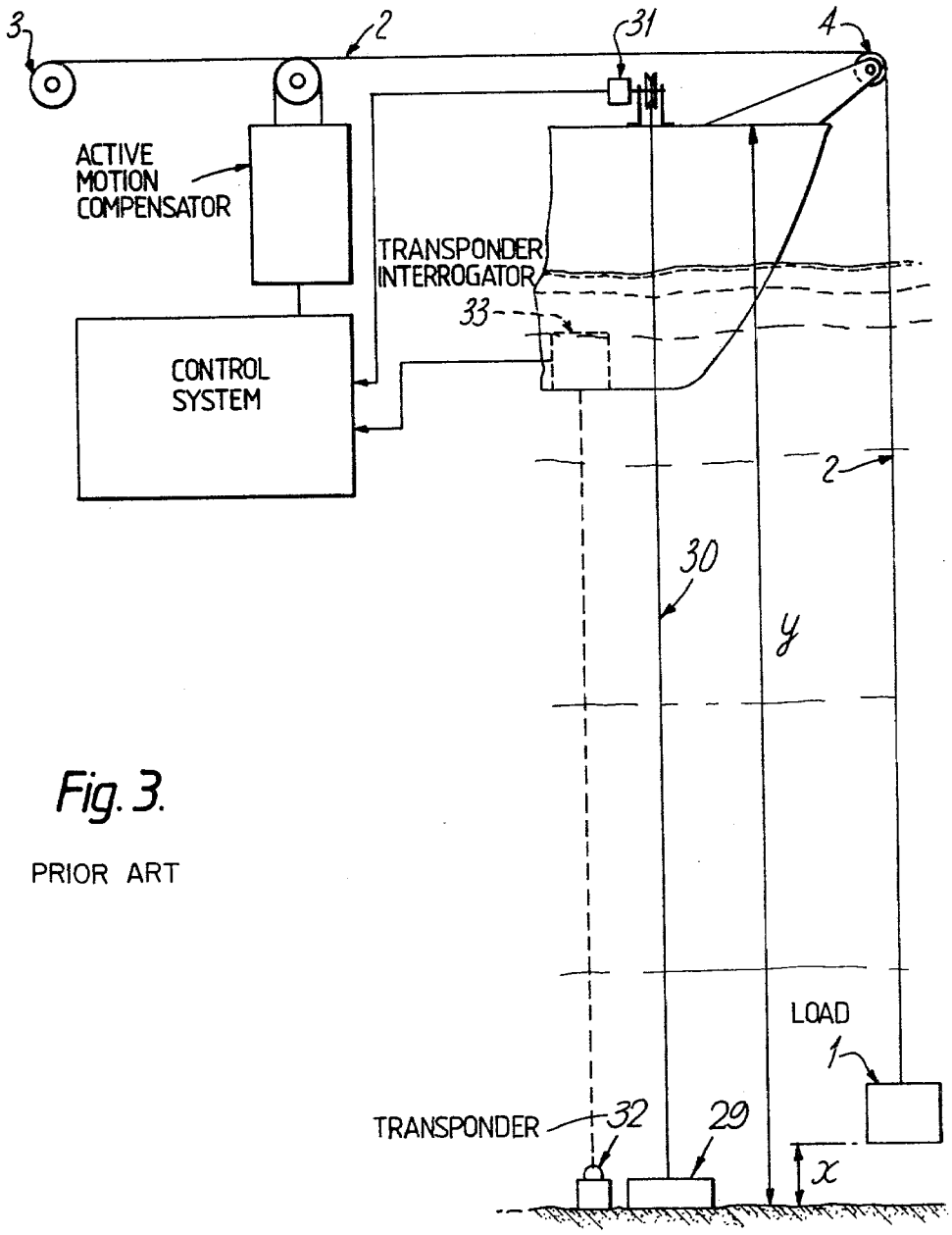
Fig. 3. PRIOR ART
FIG. 3 shows an "active" compensator with an arrangement for measuring the vessel to sea bed vertical distance.

FIG. 3 illustrates diagrammatically the alternative mode of application of the active motion compensator. In this case arrangements are made to measure the vessel to sea bed vertical distance, i.e. the dimension "y". The distance measuring arrangements may take any of several forms. One method is to use a sinker weight 29 which is lowered to the sea bed by a rope 30 which is held under constant tension by equipment not shown. Attached to a suitable drum or pulley of this system is a transducer 31 which gives rise to a distance signal for onward transmission to the control system. Alternative methods of measurement of the distance "y" include the use of a transponder 32, which is positioned on the sea bed, and a transponder interrogator 33. This unit also gives rise to a distance signal for onward transmission to the control system. A third approach to the problem of the measurement of the distance "y" is the use of a precision echo sounder unit which is positioned in the vessel at the point 33 or any other suitable location.

According to this invention, a control system of the kind referred to for an active motion compensator in which the supporting cable extending between a winch and a pulley from which the body is suspended forms a loop, the length of the loop being resiliently displaceable from an equilibrium value, wherein said length of the loop is altered in controlled response to both the measured vertical acceleration of said pulley and to the measured amplitude of oscillations in the length of said loop.

A control system according to the invention preferably incorporates an automatic drift compensating device.

Figure 4:
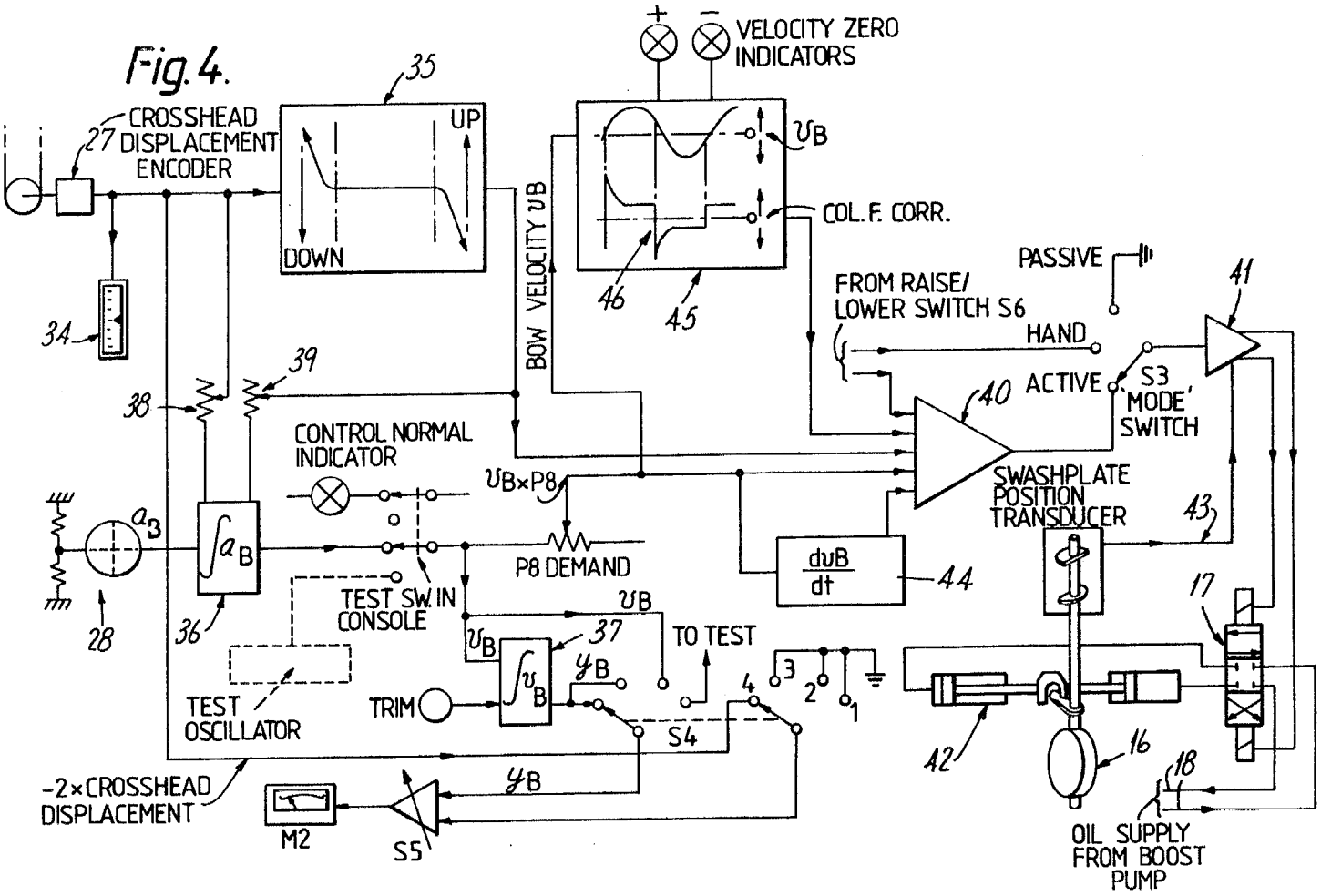
FIGS. 4 and 5 show block diagrams of control systems in accordance with the invention.
Figure 5:
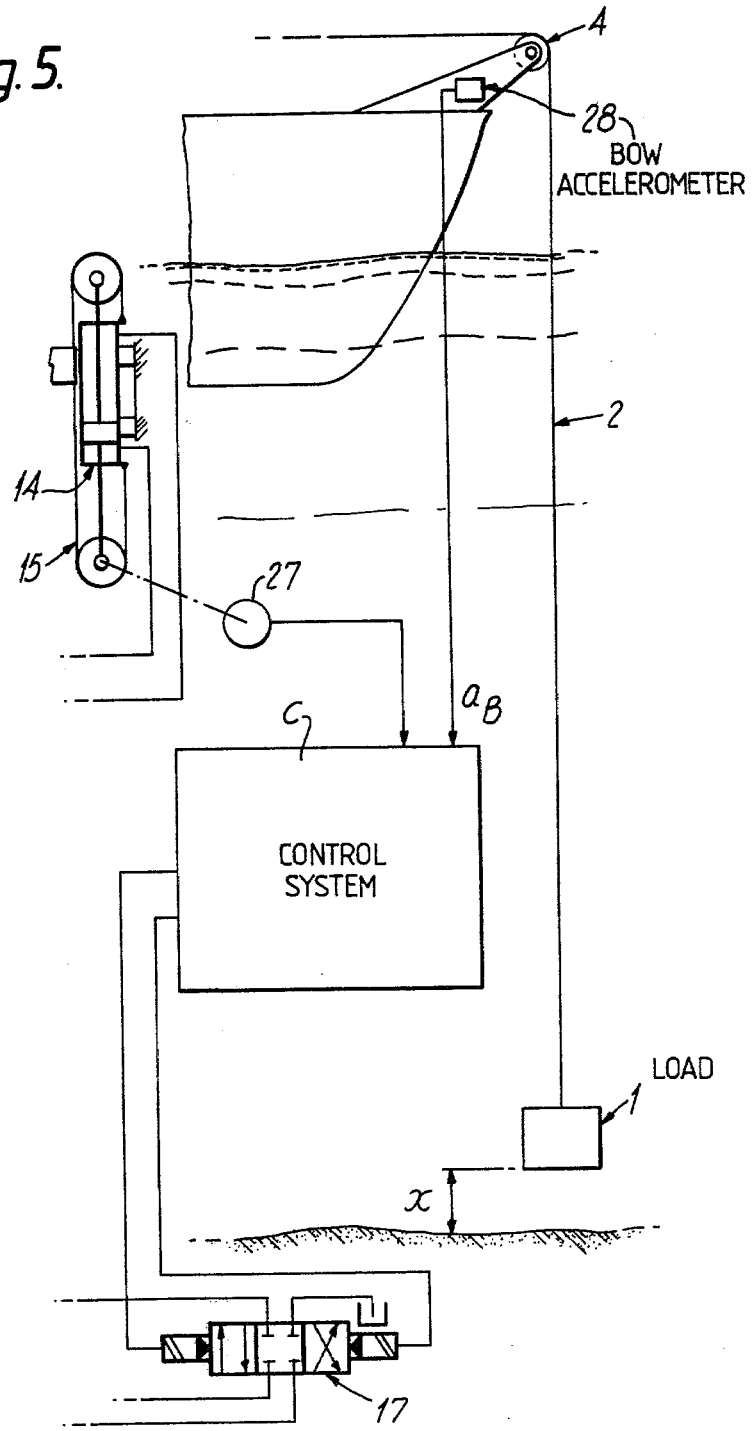

A control system in accordance with the invention is shown by way of example in FIGS. 4 and 5. As illustrated the control system incorporates the two principal elements which constitute the invention and which are necessary to achieve the required improvement in performance of an active motion compensator without vessel to sea bed distance measuring equipment, that is to say as illustrated on FIG. 2. The hydraulic system of the active motion compensator is essentially the same as that illustrated in FIG. 2, but has only been shown in part in FIGS. 4 and 5 for the sake of simplicity. In the control arrangement of the invention there are two principal transducers which give rise to input signals to the control system. These are a crosshead displacement encoder 27 which generates a digital signal of crosshead position relative to a mid point datum and a bow accelerometer 28 which produces an analogue signal proportional to the vertical acceleration at the bow pulley 4. The functions of the crosshead displacement encoder and as follows:

(i) After suitable de-coding and digital to analogue conversion the output is fed to a crosshead position indicator 34. This is a centre zero instrument which provides the operator with an indication of the amplitude of the oscillations of the crosshead 7.

(ii) The analogue signal (2x(crosshead displacement)) is fed to an end of travel limiter circuit 35. This has the characteristic shown on the diagram and provides offsetting signals to the velocity demand signal as the crosshead approaches either end limit of its travel from the mid position.

(iii) The analogue signal (2x(crosshead displacement)) is fed via position 4 of Switch 4 to a summing amplifier S5 where it is combined with a bow displacement signal. This latter signal is obtained by double integration of the bow acceleration signal produced by the bow accelerometer 28. These integrations are performed successively by the first integrator 36 and the second integrator 37. The output ($y_B$−2x(crosshead displacement)) of the summing amplifier S5 is fed to an array displacement indicator M2. This is a centre zero instrument which provides the operator with an indication of the displacement of the underwater body 1 from the desired depth. This aspect of the operation of the control system is covered in greater detail in the next section of this specification.

The remaining positions of Switch 4 provide the following facilities:

Position 1: This enables a test signal to be injected into S5 such that the satisfactory operation of the combination of S5 and M2 may be demonstrated.

Position 2: This enables the first integral of bow acceleration, i.e. bow velocity $v_B$ to be fed directly to S5. Consequently in this position M2 displays this parameter.

Position 3: This enables the double integral of bow acceleration, i.e. bow displacement $y_B$ to be fed directly to S5 without the addition of the 2x(crosshead displacement) signal. Consequently in this position M2 gives an indication of that parameter.

(iv) For automatic drift compensation the crosshead analoque signal is fed via an attenuator 38 to the first integrator 36. This has the effect of conferring on the crosshead a "centre seeking" tendency. Likewise the non-linear signal from the output side of the end of travel limiter circuit 35 is fed via an attenuator 39 to the first integrator 36. Under normal conditions this signal is zero with the crosshead 7 within its operating band but as it approaches either end of its travel an increasing signal is fed via 39 thus giving rise to a correcting tendency for the drift which can be assumed to have occurred and which caused the crosshead to move towards one or other end of its travel in the first instance.

With further reference to the bow accelerometer 28 it will be seen from FIG. 4 that its output $a_B$ after integration in the first integrator 36 is passed via an attenuator P8, as a demand velocity signal $v_B$ x P8, to a summing amplifier 40 the output of which is passed via the mode switch S3 to a further amplifier 41 where it is compared to the swash position feedback signal 43 to produce an error signal. This in turn drives the electro-hydraulic servo valve 17 to produce a flow of hydraulic fluid to the swashplate control cylinders 42 proportional to the error.

It will be noted that this control system operates overall in an essentially open loop mode. The other positions of the mode switch S3 are utilised as follows:

Passive Position

This grounds the input to the amplifier 41 and holds the position of the underwater body 1 fixed relative to the vessel.

Hand Position

This is utilised to inject a signal (via the raise/lower switch S6) into the amplifier 41 for the initial positioning of the crosshead 7 at its mid position. This facility in conjunction with the operation of the winch 3 allows the underwater body 1 initially to be positioned at the desired depth.

It will be clear to those versed in the art that the hydraulic circuit of the active system which is essentially a hydro-static loop exhibits a measure of both compliance due to fluid compressibility and slip due to fluid leakage. The effect of fluid compressibility is to produce a lag in the response of the hydro-static circuit and to reduce this effect the $V_B$ X P8 velocity demand signal is fed to a differentiator 44 and the resulting acceleration signal passed to the summing amplifier 40. The resulting lead is arranged to offset the lag produced by the system compliance. In practice the raw acceleration signal produced by the bow accelerometer 28 is not a convenient source for this signal since the bow accelerometer 28 and its immediately associated integrator 36 are both enclosed in a temperature controlled oven positioned adjacent to the head pulley 4 and considerably remote from the remainder of the control equipment.

The effect of coulomb friction throughout the system is to produce a deficit in the magnitude of the response of the system to the velocity demand signal. This effect is compensated by the coulomb friction correction circuit 45. Fundamentally this circuit takes the form of a high gain output limited amplifier which produces a truncated form of the essentially sinusoidal input wave form represented by $v_B$. The resulting approximately square wave form is in phase with the fundamental $v_B$. In order further to improve the performance of this circuit the "square" wave form is also fed to a differentiator which forms part of the coulomb friction compensation circuit 45. The differential signal is mixed with the "square" signal to produce the wave form 46 indicated on the diagram. The "square" wave element in the combined output from the coulomb friction correction circuit 45 compensates for the slip in the active system referred to above while the differential element compensates for the compliance. This combined signal which constitutes the output of the coulomb friction correction circuit 45 is fed to the summing amplifier 40 and hence is mixed with $v_B$ x P8, $(dv_B)/(dt)$ and the end of travel limiter signal to give rise to the final velocity demand signal which is fed to amplifier 41.

In practice the addition of the coulomb friction correction circuit 45 produces a useful improvement in the accuracy of station keeping of the underwater body as compared to known examples of active motion limiters not so equipped.

I claim:

1. A control system for a motion compensating arrangement for providing stabilization of a body suspended by means of a flexible line from a support structure subject to uncontrolled oscillating movements, said control system incorporating on said structure:

(A) a winch to which the line is attached, (B) a pulley over which the line passes and from which the body is suspended, and (C) a loop formed in the line between the winch and the pulley, (D) the loop having a length which is resiliently displaceable from an equilibrium value, (E) the system incorporating also an accelerometer mounted adjacent said pulley for generating a signal representative of vertical acceleration of the pulley, (F) an integrator for deriving therefrom a signal representative of vertical velocity of the pulley, (G) means for generating a signal representative of the amplitude of oscillations in the length of the loop, (H) means for combining said signals to form a stabilizing signal, (I) signal responsive means operable to alter the length of the loop in controlled response to the stabilizing signal, and (J) means for deriving from the velocity signal a compensating signal which modifies the stabilizing signal in a manner which compensates for the effect of friction in the system.

2. A control system according to claim 1 incorporating an automatic drift compensating device incorporating a travel limiter circuit for generating, on displacement of the length of the loop from the equilibrium value by more than a predetermined value, a signal controlling the winch to pay-out or draw in the line to cause the return of the loop length to its equilibrium value.

3. A control signal according to claim 1 wherein said compensating signal incorporates means for producing an approximate square wave in phase with the output signal from said integrator, a differentiator for producing from said approximate square wave a differential signal, and means for adding the differential signal to the approximate square wave to produce said compensating signal.

4. A control system according to claim 1 including a hydraulic system having one or more pistons operatively connected to control the length of said loop, and wherein the means for combining the said signals comprises a summing amplifier the output of which controls valves in the hydraulic system for controlling the movement of the piston or pistons.

* * * * *